United States Patent [19]

Winkler

[11] Patent Number: 4,981,300

[45] Date of Patent: Jan. 1, 1991

[54] SENSORY GAMES

[75] Inventor: Eric E. Winkler, Kowloon, Hong Kong

[73] Assignee: Saitek Limited, Kowloon, Hong Kong

[21] Appl. No.: 305,352

[22] Filed: Feb. 1, 1989

[30] Foreign Application Priority Data

Feb. 2, 1988 [GB] United Kingdom ..... 8802245

[51] Int. Cl.[5] ..... A63F 3/02

[52] U.S. Cl. ..... 273/238; 273/237; 273/239; 434/128

[58] Field of Search ..... 273/237, 238, 239, 260, 273/1 M; 434/128, 330

[56] References Cited

U.S. PATENT DOCUMENTS

| | | | |
|---|---|---|---|
| 3,761,092 | 9/1973 | Shieff | 273/239 |
| 3,843,132 | 10/1974 | Ferguson | 273/239 |
| 4,005,866 | 2/1977 | Marcil | 273/239 |
| 4,013,293 | 3/1977 | Hess et al. | 273/239 |
| 4,545,582 | 10/1985 | Andrews | 273/238 |
| 4,824,376 | 4/1989 | Arash | 434/330 |

FOREIGN PATENT DOCUMENTS

| | | | |
|---|---|---|---|
| 3309817 | 9/1984 | Fed. Rep. of Germany | 273/238 |
| 0148637 | 11/1979 | Japan | 273/238 |

*Primary Examiner*—Edward M. Coven
*Assistant Examiner*—Jessica J. Harrison
*Attorney, Agent, or Firm*—Townsend and Townsend

[57] ABSTRACT

A sensory electronic game which includes a board having a number of defined positions each provided with an isotropic field sensor such as a reed switch which has open and closed positions depending upon the presence or absence of a magnetic field, and two sets of playing pieces. All pieces have a magnet with its N-S axis substantially upright to provide a magnetic field which will open or close the sensor when a piece is positioned on the associated board position. To avoid a lack of detection if one piece is quickly replaced by another piece, the pieces of one set have the N pole facing downwardly whilst the pieces of the other set have the S pole facing downwardly. Then, by detecting the opening and closing of the sensors including momentary open and closed positions during capture or replacement of a piece of one set by a piece of another set, movement of pieces can be determined.

6 Claims, 1 Drawing Sheet

SENSORY GAMES

This invention relates to sensory games.

BACKGROUND TO THE INVENTION

Most chess computers with "presence sensor" systems use reed switches and magnets to track the moves of the chess pieces on the chessboard. These systems usually have one reed switch placed under each square of the chessboard (64 reed switches in total). A magnet is positioned in the base of each chess piece. When a piece is placed on a chess square, the reed switch is activated and remains closed until the piece is removed. Thus, the identities of the pieces on the game board may be tracked by the electronics if the pieces start from predefined positions, e.g. a new game or a set-up position defined.

The polarity of the magnets in the pieces is randomly oriented, i.e. some pieces have a south pole downwardly while others may have the north pole facing downwardly. Both will activate the reed switches in normal non-capturing moves where a piece is lifted up and placed onto the new destination square. The electronics can sense this open and close circuit of the reed switch with no problem.

The situation is different if it is a capturing move. On the square of the piece to be captured, the reed switch is closed because there is a piece on it. The piece is then lifted and removed, the reed switch becoming open circuit, and then the capturing piece is put onto the square whereupon the reed switch closes again. The close-open-close action of the reed switch informs the electronics of the capturing move.

If the capturing action is very fast, however, the reed switch may have no opportunity to open since the magnetic force of a capturing piece with the same polarity may overlap and mutually strengthen the magnetic field and so activate the reed switch before the captured piece is removed; thus the reed switch may never open and the electronics will then not register the final step of the move.

With chess, it is not unusual for many good chess players to capture a piece by seizing it between the thumb and index finger of a hand, replacing it by the capturing piece held between the index and middle finger of the same hand or vice versa. Therefore this problem is particularly acute with chess.

Thus, error may occur if the capturing action is fast and if the piece to be captured and the capturing piece have magnets of the same polarity. However, if according to the invention the polarities of the magnets are intentionally oriented so that all of black pieces, i.e. pieces of one set, have their magnets with the same polarity facing downwards and all of the white pieces, i.e. the pieces of the other set, have the opposite, then a close-open-close action on the reed switch of the respective square or board position can be guaranteed. Thus, if a reed switch is, for example, activated by a magnetic field of a north pole, replacing it with a magnetic field of the opposite polarity will cause the reed switch to open as the null-field zone approaches it. The reed switch will close again finally once the capturing piece controls the square.

From experimental results, the duration of opening of the reed switch in these circumstances is at least 4 milliseconds even when the capturing action is reasonably fast, compared with a typical bounce time of a typical reed switch of 0.4 milli-second, i.e. an order of magnitude smaller. Thus, this is enough time for the electronics and/or the controlling software to distinguish capture from contact bounces of the reed switches.

BRIEF SUMMARY OF THE INVENTION

According to the invention there is provided a method of detecting the capture or replacement of a playing piece of one set by a playing piece of another set on a defined position on a game board, in which each board position is provided with an isotropic field strength sensor which has open and closed positions depending upon the presence or absence of a magnetic field, and each playing piece is provided with a magnet with its N-S axis substantially upright, the pieces of one set having the N pole facing downwardly and the pieces of the other set having the S pole facing downwardly, and electronics and/or software sense the momentary open or close position of the sensor during capture or replacement depending respectively upon whether the sensor is initially closed or open when a piece is present on the defined position.

Also according to the invention there is provided a sensory electronic game including a board having a number of defined positions each with an isotropic field strength sensor which has open and closed positions depending upon the presence or absence of a magnetic field, and two sets of playing pieces, all pieces having a magnet with its N-S axis substantially upright, the pieces of one set having the N pole facing downwardly whilst the pieces of the other set having the S pole facing downwardly, and means for detecting the opening and closing of the sensors including momentary open and closed positions during capture or replacement of a piece of one set by a piece of another set, and logic means for storing the position of all playing pieces, the logic means being updated by the detecting means when they detect movement of a piece by the opening and/or closing of a sensor.

The isotropic field strength sensors can be reed switches since these are relatively cheap and reliable. As an alternative, however, one could use Hall effect sensors which are sensitive to a magnetic field and its orientation and so can act as switches depending upon the direction of a magnetic field to which they are exposed.

DESCRIPTION OF THE DRAWINGS

The invention will now be illustrated, by way of example with reference to the accompanying drawings, in which.

DESCRIPTION OF THE PREPARED EMBODIMENT

Figure 1:
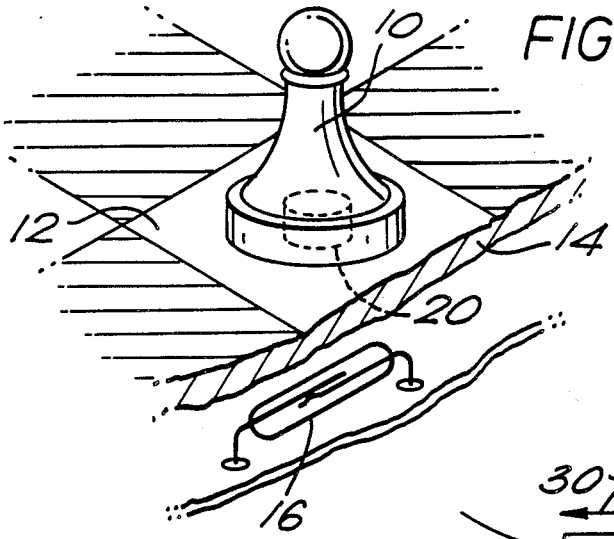
FIG. 1 is a perspective broken away diagram of a chess game and board.

FIG. 1 is a diagram showing a sensory chess game. It shows a chess piece 10 resting on a white square 12 of a board 14. Beneath the square 12 is a reed switch 16 associated with that square. The piece 10 has in its base a small magnet 20 with N-S axis aligned substantially upright. When the piece 10 is present as the square 12 the magnetic field of the magnet 20 will cause the contacts in the reed switch 20 to close, so signalling the presence of a piece on the square 12.

The opening and closing of the reed switches can be used entirely conventionally to detect moves on the chess board, for example in the manner known from existing sensory chess games such as those which we market under the trade names Leonardo and Corona. Accordingly further description of the electronics and software conventionally associated with such switches is believed to be unnecessary.

Figure 2:
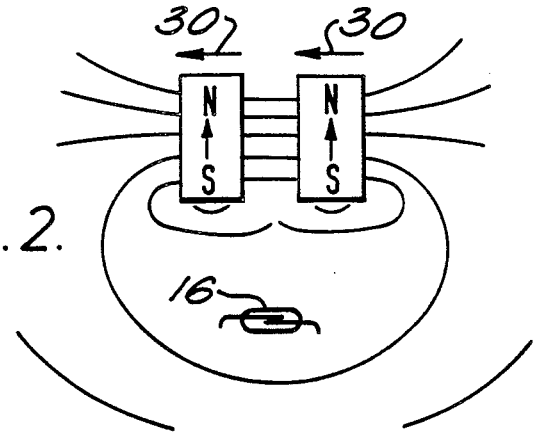
FIGS. 2 and 3 are diagrams showing the magnetic fields as chess pieces are moved.

The diagram of FIG. 2 shows the magnetic fields from two magnets 20 as one piece captures another when the axes of the two magnets are aligned in the same sense, e.g. both magnets with the N pole upwards. The field lines on this diagram are equipotential lines, lines of magnetic force are at right angles to these lines. As the magnets move in the direction of the arrows 30, it can be seen that there is little change in the magnetic field and at all times there is sufficient field to hold the contacts on the reed switch 16 closed.

Figure 3:
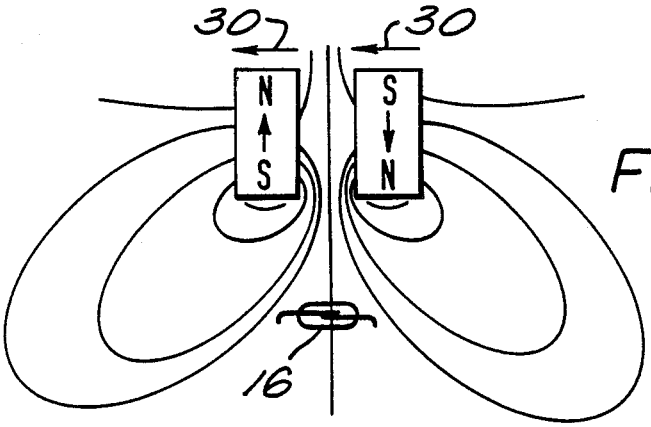

By contrast when the magnets in the black and white pieces are different, e.g. when all of the white pieces have their N pole uppermost and all of the black pieces have their S pole uppermost, this cannot occur during capture. Thus, referring to the diagram of FIG. 3 which shows the situation where the magnets are oppositely aligned, as the magnets with oppositely aligned poles are moved past the reed switch in the direction of the arrows 30, there is inevitably a null point in the magnetic field when the contacts will open as the field changes from one orientation to the other.

Although the invention has been particularly described with reference to chess, the invention has application in a wide a range of games such as Backgammmon, Checkers, Shogi and Chinese Chess.

A Latitude of modification, change and substitution is intended in the foregoing disclosure an in some instances some features of the invention will be employed without a corresponding use of other features. Accordingly it is appropriate that the appended claims be construed broadly and in a manner consistent with the spirit and scope of the invention herein.

I claim:

1. A sensory electronic game comprising a board, a number of defined positions on said board, an isotropic magnetic field sensor associated with each of said defined positions, said sensors having open and closed positions depending upon the presence or absence of a magnetic field, a first set of playing pieces and a second set of playing pieces, all of said pieces having a magnet with its N-S axis substantially upright, the pieces of said first set having the N pole facing downwardly and the pieces of said second set having the S pole facing downwardly, means for detecting the opening and closing of said sensors including momentary open and closed positions during capture or replacement of a piece of one set by a piece of another set, and logic means for storing the position of all playing pieces, the logic means being updated by the detecting means when they detect movement of a piece by the opening and/or closing of a sensor.

2. A sensory electronic- game as claimed in claim 1 in which the isotropic magnetic field sensors are reed switches.

3. A sensory electronic game as claimed in claim 2 which is a chess game.

4. A method for detecting capture or replacement of a playing piece on a defined position of a game board comprising:

providing a game comprising a game board on which there are a number of defined positions wherein each of said defined board positions is associated with an isotropic magnetic field sensor that has open and closed positions depending upon the presence or absence of a magnetic field, a first set of playing pieces and a second set of playing pieces wherein each playing piece is provided with a magnet having its N-S axis substantially upright and further wherein the pieces of a first set have the N pole facing downwardly and the pieces of a second set have the S pole facing downwardly, means for detecting the opening and closing of said sensors including momentary open and closed positions during capture or replacement of a piece of the first set by a piece of the second set or of a piece of the second set by a piece of the first set, and logic means for storing the positions of all playing pieces wherein the logic means is updated by the detecting means when the movement of a piece is detected by the opening or closing of said sensor;

moving a playing piece from a first defined position to a second defined position on the game board;

determining the movement of the playing piece with the detecting means; and storing the detected second defined position in the logic means.

5. The method of claim 4 in which said isotropic magnetic field sensors are reed switches.

6. The method of claim 5 in which the game is a chess game.

* * * * *